US010562597B2

(12) United States Patent
Lange

(10) Patent No.: US 10,562,597 B2
(45) Date of Patent: Feb. 18, 2020

(54) CLASPING, ADJUSTABLE LENGTH BOATHOOK

(71) Applicant: Guy A. Lange, Key Largo, FL (US)

(72) Inventor: Guy A. Lange, Key Largo, FL (US)

(73) Assignee: Guy A. Lange, Key Largo, FL (US)

( * ) Notice: Subject to any disclaimer, the term of this patent is extended or adjusted under 35 U.S.C. 154(b) by 94 days.

(21) Appl. No.: 15/986,242

(22) Filed: May 22, 2018

(65) Prior Publication Data

US 2019/0359293 A1 Nov. 28, 2019

(51) Int. Cl.
*B63B 21/54* (2006.01)

(52) U.S. Cl.
CPC ..... *B63B 21/54* (2013.01)

(58) Field of Classification Search
CPC ..... B63B 21/54
USPC ..... 294/191, 209, 210, 211
See application file for complete search history.

(56) References Cited

U.S. PATENT DOCUMENTS 2,807,495 A * 9/1957 Pillstrom ..... A01K 15/003 294/104
3,048,139 A * 8/1962 Duckett ..... B63B 21/54 114/221 R
3,897,621 A 8/1975 Fedrigo
3,993,013 A 11/1976 Nunziato et al.
4,004,539 A * 1/1977 Wesson ..... B63B 21/54 114/221 R
4,076,437 A 2/1978 Mazzolla
4,793,646 A * 12/1988 Michaud, Jr. ..... B63B 21/54 114/221 R
4,881,338 A * 11/1989 Lung ..... A01K 97/14 43/5
5,724,762 A * 3/1998 Thompson ..... A01K 97/24 43/17.2
5,941,587 A * 8/1999 Wolff ..... B25J 1/04 294/103.1
6,363,876 B1 4/2002 Blake
7,299,765 B1 11/2007 Phelps
8,328,257 B1 * 12/2012 La Coste ..... B63B 21/54 114/230.25
8,813,414 B2 8/2014 Jones et al.
(Continued)

FOREIGN PATENT DOCUMENTS

AU 2004200242 B2 2/2011

*Primary Examiner* — Paul T Chin
(74) *Attorney, Agent, or Firm* — Davis, Malm & D'Agostine, P.C.; Richard L. Sampson

(57) ABSTRACT

An adjustable length boathook includes a user-actuable hook at its distal end for securely grasping lines and the like. By enabling firm control of the line, the claimed embodiments facilitate specific maneuvers such as hooking a line around a cleat. The boathook uses first and second tubes telescopingly engaged for slidable movement along a common central axis, with third and fourth tubes disposed coaxially and internally thereto, the telescoping engagement providing length adjustability. Cam-lock devices are disposed between the first and second tubes, and between the third and fourth tubes, and lock their respective tubes to one another at a desired length. A handle is slidably disposed at a proximal end of the first tube to actuate the third tube in the axial direction relative to the first tube. A user-actuatable hook at the distal end of the second tube is actuated by the fourth tube.

26 Claims, 5 Drawing Sheets

(56) References Cited

U.S. PATENT DOCUMENTS

| | | | | |
|---|---|---|---|---|
| 2007/0186835 | A1* | 8/2007 | Follmer | B63B 21/54<br>114/230.1 |
| 2012/0048167 | A1* | 3/2012 | Teruzzi | B63B 21/00<br>114/221 R |

* cited by examiner

CLASPING, ADJUSTABLE LENGTH BOATHOOK

BACKGROUND

Technical Field

This invention relates to marine docking and anchoring equipment, and more particularly to an adjustable length boathook having a user-actuable hook at its distal end for grasping lines and the like.

Background Information

In connection with the use of small boats, such as rowboats, sail boats, cabin cruisers, outboard motor boats, and the like, an ever present issue is that of leaving a dock or mooring, and of tying up to a dock or mooring, without difficulty, and without damaging the boat or any other boats adjacent thereto, as in a marina. Where someone is present on the dock, someone on the boat can throw a line and have the boat tied up quickly when drawn in by means of the line. However, when there is not another person on the dock capable of aiding in the docking or mooring of the boat, problems may arise. This is especially true when the boat is approaching a docking slip, as in a marina, where there are often dock posts sunk into the water around the slip, and there is often very little spacing between boats in their respective slip areas.

A variety of boathooks are available to assist a user with this process of docking and mooring a boat, including the process of hooking and unhooking a line from a boat mooring or dock. However, all the known prior art devices suffer from a number of associated drawbacks. For example, adjustable length telescoping boathooks may be conveniently extended during use and then collapsed for storage. Such devices, however, generally include fixed hooks that do not facilitate grasping a line.

The instant inventor recognized firsthand the desirability of having a boathook capable of grasping a line when trying to secure a boat that was lurching about in its slip during a day of high winds. The anchor had come free and was banging against the hull, and it was too dangerous to board the boat, the problem needed to be addressed from the dock. Using a conventional boathook with a fixed hook, the present inventor was able to place the anchor back in its roller holder, lash it in place, and then double knot it so it could not come free. However, the process was extremely time consuming due to the unfavorable conditions and slippage of the line through the fixed hook. The inventor thus recognized that conventional adjustable length boathooks are well suited for retrieving lines at a distance. Their fixed hooks are, however, inadequate for the purpose of accurately placing a line at or on a desired location or fixture. Moreover, although actuatable hooks may be placed at the end of fixed length boathooks, they heretofore have been incapable of use with adjustable length boathooks.

A need therefore exists for an improved boathook that addresses the aforementioned issues.

SUMMARY

The appended claims may serve as a summary of the invention. The features and advantages described herein are not all-inclusive and, in particular, many additional features and advantages will be apparent to one of ordinary skill in the art in view of the drawings, specification, and claims.

Moreover, it should be noted that the language used in the specification has been principally selected for readability and instructional purposes, and not to limit the scope of the inventive subject matter.

BRIEF DESCRIPTION OF THE DRAWINGS

The present invention is illustrated by way of example and not limitation in the figures of the accompanying drawings, in which like references indicate similar elements and in which.

DETAILED DESCRIPTION

Figure 1:
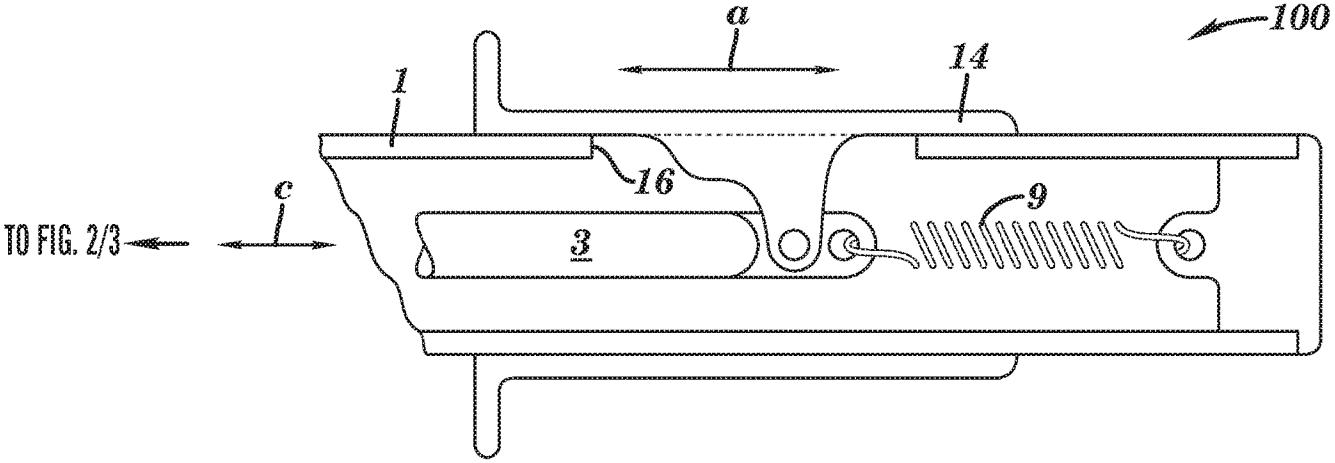
FIG. 1 is a schematic cross-sectional view taken along a longitudinal axis of a proximal end portion of an embodiment of the present invention.

In the following detailed description, reference is made to the accompanying drawings that form a part hereof, and in which is shown by way of illustration, specific embodiments in which the invention may be practiced. It should be recognized that the drawings are schematic and not to scale. These embodiments are described in sufficient detail to enable those skilled in the art to practice the invention, and it is to be understood that other embodiments may be utilized. It is also to be understood that structural, procedural and system changes may be made without departing from the spirit and scope of the present invention. In addition, well-known structures, circuits and techniques have not been shown in detail in order not to obscure the understanding of this description. The following detailed description is, therefore, not to be taken in a limiting sense, and the scope of the present invention is defined by the appended claims and their equivalents.

General Overview

The aforementioned issues have been addressed by the claimed method and apparatus in the form of an adjustable length boathook with a user-actuable hook at its distal end for securely grasping lines and the like. By enabling firm control of the line, the claimed embodiments make specific maneuvers such as hooking a line around a cleat or piling on a dock, passing a line to another boat, or maneuvering a line around an obstruction, as in the case of passing a bridle over an outboard motor, much easier, more accurate, and more reliable.

One early approach devised by the present inventor used a lever linked to the hook with a cable. Actuating the lever would pull on the cable, which in turn would actuate the hook which rotated on an axis to firmly grasp the desired line. A difficulty with this concept was that it was practically impossible to make the device extendable, which has been shown to be a popular feature of conventional boathooks. After many struggles to resolve this problem, the present inventor devised the claimed solution which involves an adjustable length pushrod to effect the desired hook actuation.

Embodiments of the claimed invention include a clasping boathook that resembles commercially available boathooks (hereafter referred to as "conventional" boathooks) in many ways, such as length, materials, and general construction. For example, the body of these embodiments may be fabricated from aluminum tubing having an outer diameter (OD) in the range of ¾ to ⅞ inches. Also similarly to conventional boathooks, the distal end may be tapered and/or rounded, optionally with a soft or resilient surface to avoid scratching or otherwise damaging boat surfaces, etc. Moreover, like conventional boathooks, the proximal end has a handle. Still further, like many conventional boathooks, these embodiments use telescoping tubes to facilitate length adjustment, though unlike many conventional boathooks, these embodiments may use the larger diameter of the telescoping tubes at the distal, rather than the proximal, end of the boathook in order to accommodate internal moving parts.

In other respects, the embodiments of the present invention are substantially distinct from conventional approaches. For example, while the hook of the claimed invention resembles that of conventional boathooks in material, in particular embodiments it includes two rounded bight portions, one on the distal side, and another on the proximal side, sized and shaped to accommodate the diameter of a line therein. Moreover, while the hook portion is immovably affixed to the distal end portion of conventional adjustable-length boathooks, the hook of the inventive embodiments is pivotably secured for "clasping" movement, and is actuated by an internal rod connected to a handle at the proximal end of the boathook, as will be discussed in greater detail hereinbelow. The handle, which may be spring loaded, can be pushed forward to rotate the hook on its axle to clamp down and trap a line in a bight of the hook as desired. Extendibility is achieved by using cam-lock devices on both the outer telescoping tubes and the inner push rod tubes.

Terminology

As used in the specification and in the appended claims, the singular forms "a", "an", and "the" include plural referents unless the context clearly indicates otherwise. For example, reference to "a tube" includes a plurality of such tubes.

Although specific terms are employed herein, they are used in a generic and descriptive sense only and not for purposes of limitation. All terms, including technical and scientific terms, as used herein, have the same meaning as commonly understood by one of ordinary skill in the art to which this invention belongs unless a term has been otherwise defined. It will be further understood that terms, such as those defined in commonly used dictionaries, should be interpreted as having a meaning as commonly understood by a person having ordinary skill in the art to which this invention belongs. It will be further understood that terms, such as those defined in commonly used dictionaries, should be interpreted as having a meaning that is consistent with their meaning in the context of the relevant art and the present disclosure. Such commonly used terms will not be interpreted in an idealized or overly formal sense unless the disclosure herein expressly so defines otherwise.

Where used in this disclosure, the term "axial" when used in connection with an element described herein, refers to a direction relative to the element, which is substantially parallel to longitudinal axis c when the element is installed on the boathook as shown in FIGS. 1-4. Similarly, the term "transverse" refers to a direction other than substantially parallel to the axial direction. The terms "transverse cross-section" or "transverse circumference" shall refer to a cross-section or circumference, respectively, taken along a transverse plane.

Figure 4:
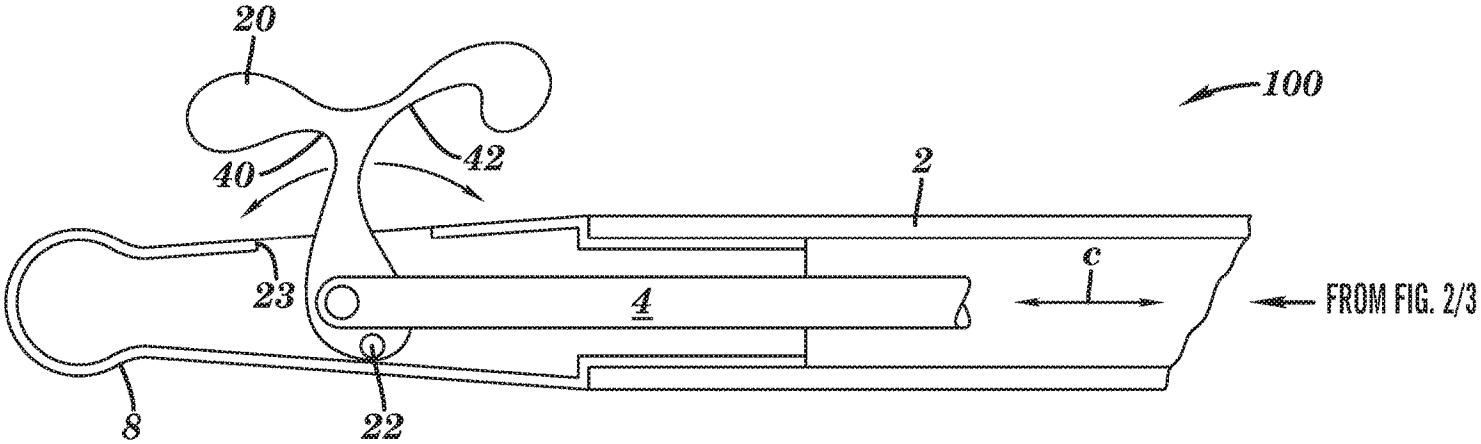
FIG. 4 is a view similar to that of FIG. 1, of a distal end portion of the embodiment of FIGS. 1-3.

Referring now to the accompanying figures, embodiments of the present invention will be more thoroughly described. As shown, an embodiment of the inventive boathook 100 takes the form of four telescoping cylinders or tubes 1, 2, 3, 4 and two cam-lock devices 10 and 12. As best shown in FIG. 1, the proximal or 'handle' end portion of the boathook 100 includes a handle 14 slidably disposed at a proximal end of tube 1. Handle 14 is slidable relative to tube 1 in the axial direction a to correspondingly actuate tube 3 in the axial direction relative to tube 1. As shown in FIG. 4, user-actuatable hook 20 is pivotably secured via a pivot pin 22 to a distal or 'hook' end portion of tube 2. Hook 20 is also pivotably secured to tube 4 so that hook 20 is pivoted in response to axial movement of tube 4 relative to tube 2. In particular embodiments, tube 2 may be provided with a tapered and/or rounded distal end portion 8, optionally fabricated from a relatively soft and/or resilient material, to avoid scratching or otherwise damaging boat surfaces, etc.

Figure 2:
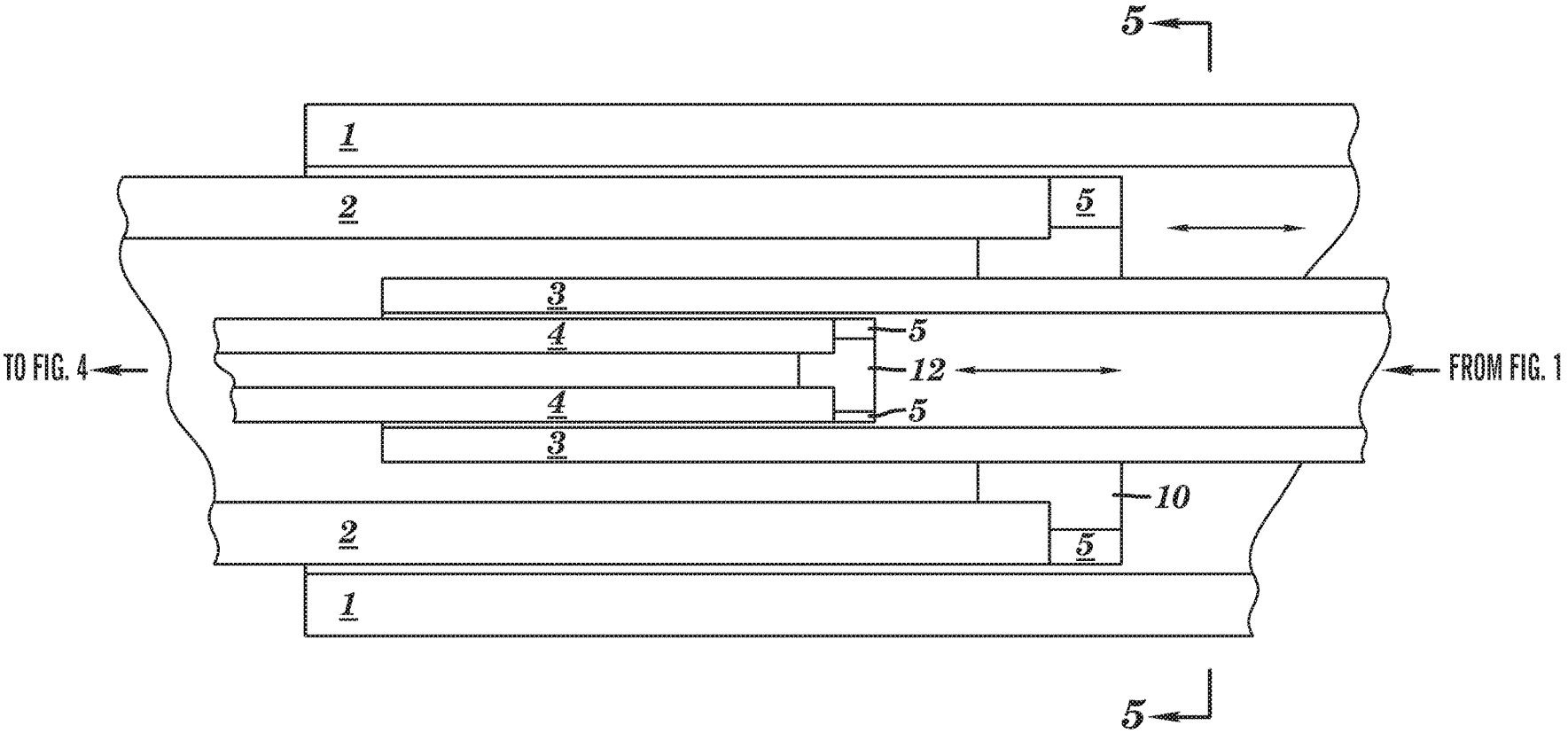
FIG. 2 is a view similar to that of FIG. 1, of a middle portion of the embodiment of FIG. 1.
Figure 3:
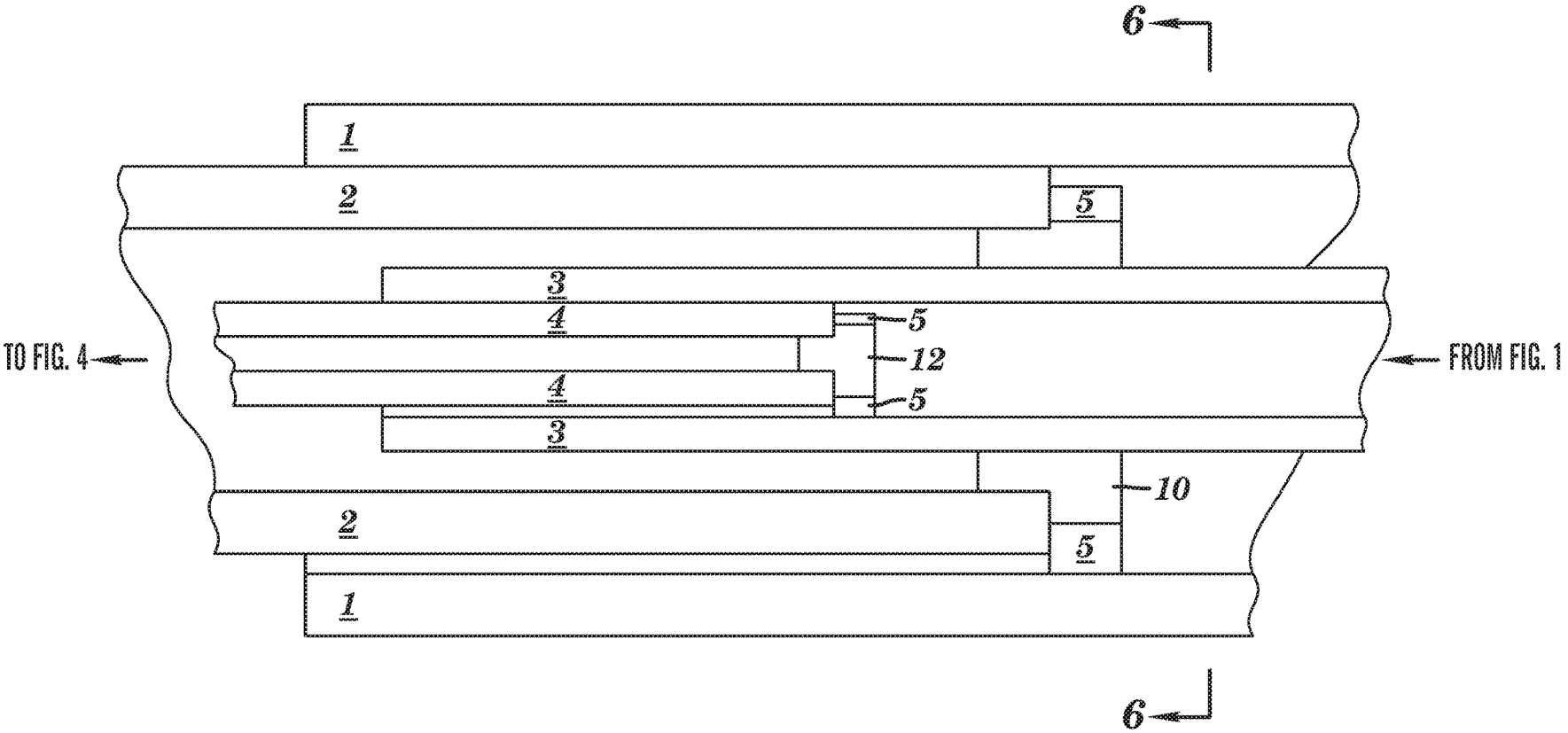
FIG. 3 is a view similar to that of FIG. 2, with the middle portion of FIG. 2 shown in an alternate operating position.

Turning to FIGS. 2 and 3, tubes 1 and 2 are telescopingly engaged for slidable movement relative to one another along a common central axis c (FIG. 1). Tubes 3 and 4 are disposed coaxially with, and internally to, tubes 1 and 2. Tubes 3 and 4 are telescopingly engaged for slidable movement relative to one another in the axial direction in tandem with the axial movement of tubes 1 and 2. This telescoping engagement permits the user to adjust the overall length of boathook 100, from the proximal end portion to the distal end portion.

First cam-lock device 10 is disposed between tubes 1 and 2, so that torsional movement about axis c of tube 1 relative to tube 2 moves cam-lock device 10 between tight and loose positions. These tight and loose positions respectively oppose and permit axial movement of tubes 1 and 2 relative to one another.

Second cam-lock device 12 is disposed between tubes 3 and 4 and operates similarly to first cam-lock device 10. Torsional movement about axis c of tube 3 relative to tube 4 moves second cam-lock device 12 between tight and loose positions that respectively oppose and permit axial movement of tubes 3 and 4 relative to one another.

Moreover, as will be discussed in greater detail hereinbelow, tubes 1 and 3 move torsionally in tandem with one another, e.g., so that clockwise movement of tube 1 also serves to move tube 3 clockwise, and vice versa. Similarly, tubes 2 and 4 also move torsionally in tandem with one another. The effect of this tandem movement is that a user grasping tube 2 with one hand, and tube 1 with the other hand, will be able to alternately twist and untwist tubes 1 and 2 relative to one another to simultaneously move cam-lock devices 10 and 12 between their tight and loose positions.

Figure 5:
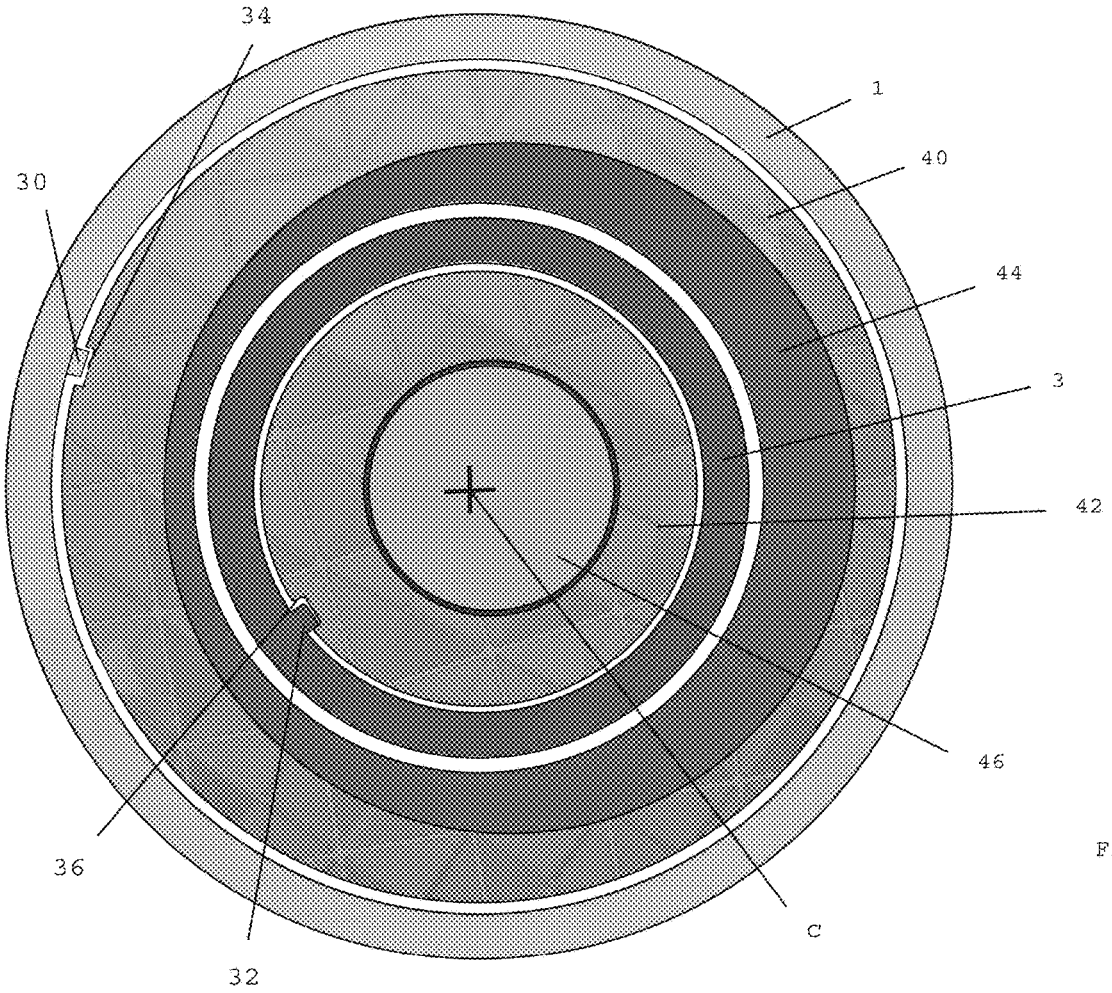
FIG. 5 is a cross-sectional view, on an enlarged scale, taken along 5-5 of FIG. 2.
Figure 6:
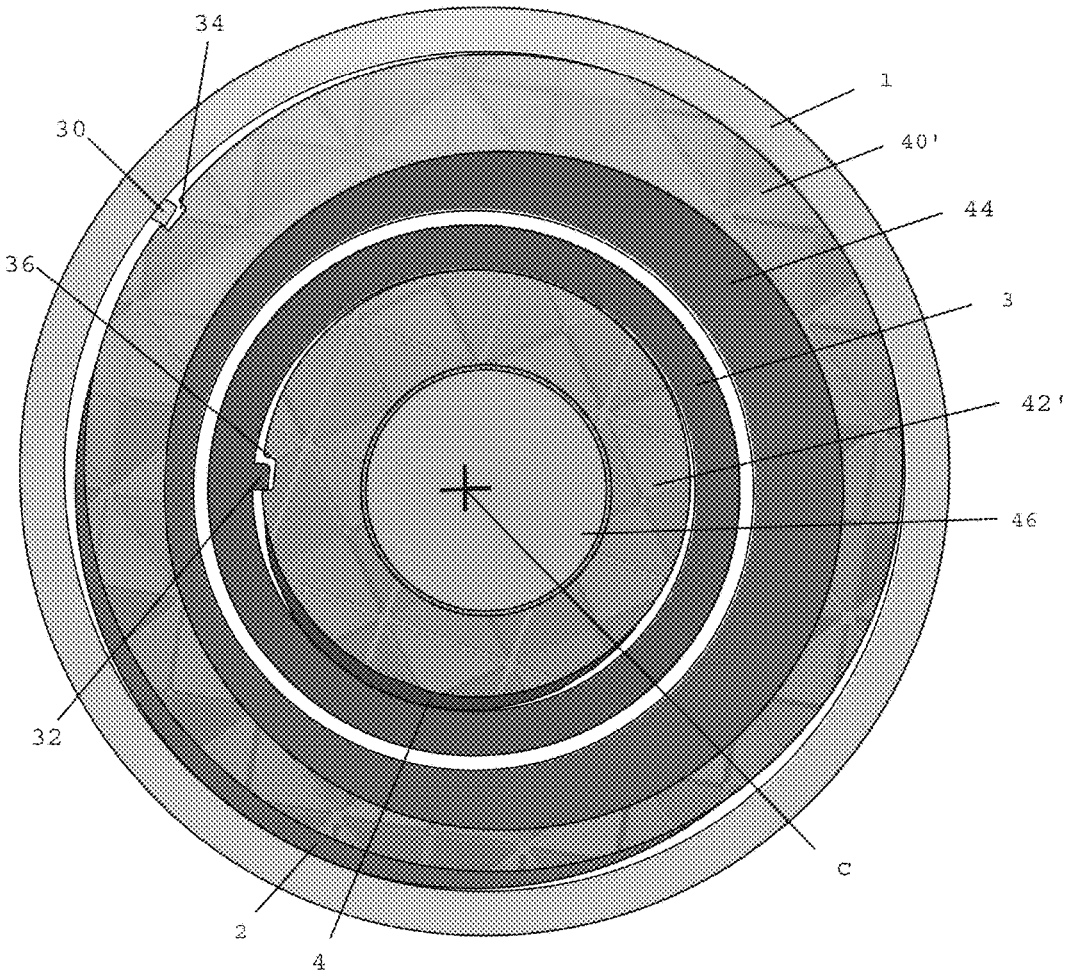
FIG. 6 is a cross-sectional view, on an enlarged scale, taken along 6-6 of FIG. 3.

Turning now to FIGS. 5 and 6, in particular embodiments, cam locks 10 and 12 are substantially conventional devices, respectively including arcuate wedge-shaped cam followers 40 and 42, configured to slidably follow the surfaces of circular cams 44 and 46 disposed eccentrically about axis c. It should be noted that, as best shown in FIGS. 2 and 3, cams 44 and 46 are rigidly disposed at proximal ends of tubes 2 and 4, respectively.

As shown in FIG. 5, cam-lock devices 10 and 12 are both in their loose positions, in which cam-follower 40 of device 10 is spaced from tube 1, and cam-follower 42 of device 12 is spaced from tube 3. As also shown, in particular embodiments cam-followers 40 and 42 are keyed to tubes 1 and 3, e.g., with axially extending abutments 30 and 32 respectively received within similarly sized and shaped slots 34 and 36. As mentioned above, when in this loose position, the telescoping tubes are free to move in the axial direction a (FIG. 1), to adjust the length of the boathook 100.

As shown in FIG. 6, tubes 1 and 3 have been rotated torsionally in the clockwise direction, relative to tubes 2 and 4, to move cam-lock devices 10 and 12 into their tight positions. As shown, when in its tight position, cam-follower 40 has slid along the surface of cam 44 to effectively become wedged between cam 44 and the inside surface of tube 1.

Moreover, since cam 44 is rigidly secured to the end of tube 2 (FIGS. 2 and 3), this wedging action of cam-follower 40 also pushes tube 2 into contact with the inside surface of tube 1 at a location diametrically opposite the portion of tube 1 engaged by cam-follower 40. This positioning creates a tight frictional engagement that opposes axial movement of the tubes 1 and 2 relative to one another.

Similarly, when in its tight position, cam-follower 42 has slid along the surface of cam 46 to effectively become wedged between cam 46 and the inside surface of tube 3. Since cam 46 is rigidly secured to the end of tube 4 (FIGS. 2 and 3), this wedging action of cam-follower 42 pushes tube 4 into contact with the inside surface of tube 3 at a location diametrically opposite the portion of tube 4 engaged by cam-follower 42. This positioning creates a tight frictional engagement that opposes axial movement of the tubes 3 and 4 relative to one another.

Referring back to FIG. 1, as mentioned hereinabove, while tubes 1 and 3 are slidable relative to one another in the axial direction, they are also fixed to one another in the torsional direction. Tubes 2 and 4 are similarly slidable relative to one another in the axial direction, while being fixed to one another in the torsional direction. In particular embodiments, this capability of tubes 1 and 3 is provided by slidably capturing the handle 14 within an axially extending slot 16 of tube 1 to permit the handle to slide relative to tube 1 in the axial direction a. Handle 14 includes a blade portion 18 that extends radially inwardly through slot 16 to immovably (fixedly) engage the proximal end of tube 3, e.g., with a mechanical fastener such as a rivet or bolt as shown, so that tube 3 is slidable axially with the handle 14 relative to tube 1. The axially extending walls of the slot 16 slidably engage blade portion 18 to effectively limit movement of the handle 14 relative to tube 1 in the torsional direction. The handle 14 thus couples tubes 1 and 3 to one another so that tubes 1 and 3 are fixed to one another in the torsional direction. It should be noted that in particular embodiments, a biasing means such as a spring 9 may be disposed between tube 1 and tube 3, to bias the handle towards a rest position. In the embodiment shown, the rest position is at the proximal end of tube 1.

Turning to FIG. 4, tubes 2 and 4 are similarly slidable relative to one another in the axial direction, while being fixed to one another in the torsional direction. In particular embodiments, this capability is provided by slidably capturing the hook 20 within an axially extending slot 21 at a distal end portion of tube 2 and pivotably fastening the hook to tube 2 with a first pivot pin 22 passing through a base portion of the hook 20, to enable the hook to pitch (pivot) relative to the axial direction a while limiting movement of hook 20 relative to tube 2 in the torsional direction. Hook 20 is also pivotably fastened to a distal end portion of tube 4, e.g., with a second pivot pin 23 that passes through the base portion of the hook at a position spaced from the first pivot pin 22, so that axial movement of tube 4 serves to effectively pivot the hook 20 between open and closed positions. The axially extending walls of the slot 21 slidably engage hook 20 to effectively limit movement of the hook relative to tube 2 in the torsional direction. The hook 20 thus couples tubes 2 and 4 to one another, so that tubes 2 and 4 are fixed to one another in the torsional direction, i.e., torsional movement of tube 2 generates similar torsional movement of tube 4.

With this construction, torsional movement of the handle 14 to the loose position (as shown in FIG. 5) enables telescoping movement of tubes 1 and 3 relative to tubes 2 and 4 to vary the length of the boathook 100. Torsional movement of the handle 14 to the tight position (as shown in FIG. 6) engages the cam-lock devices 10 and 12 to substantially lock the boathook 100 at a desired length while also locking the hook actuation tubes 3 and 4.

Subsequent back and forth axial movement of the handle 14 relative to tube 1 serves to respectively actuate the hook 20 between open and closed positions.

It should be noted that in particular embodiments, the hook 20 is double sided, as shown in FIG. 4, so that whether the hook is in the 'open' and 'closed' position will depend on which bight portion is being considered. For example, hook 20 may include a first bight portion 40 on a distal side, and a second bight portion 42 on a proximal side. Axial movement of the handle 14 towards the distal end of the boathook will thus pivot hook 20 to close bight portion 40 while opening bight portion 42, and vice versa when handle 14 is moved towards the proximal end of the boathook. Moreover, in particular embodiments, bight portions 40 and 42 are each sized and shaped to receive a line therein, e.g., to clamp the line when in its 'closed' position.

It should be noted that the various components of the foregoing embodiments may be fabricated from substantially any suitable materials known to those skilled in the art. For example, the tubes may be fabricated from metals such as aluminum, from polymeric materials such as PVC or polyamide, or by combinations thereof. The cam-lock devices may be similarly fabricated from a variety of materials including metals, although in particular embodiments, polymeric materials may be desired in order to provide some resiliency that may facilitate the aforementioned wedging and unwedging action.

The hook 20, as well as the rounded distal end portion 8 of tube 2 may also be fabricated from a polymeric material to help avoid scratching or otherwise damaging boats during use.

During operation, as best shown in FIGS. 2 and 3, the boathook is operated by twisting tubes 1 and 2 relative to one another to move the cam locks 10 and 12 into their open/disengaged positions as shown in FIG. 2. This permits the user to slide tube 1 telescopically relative to tube 2, which similarly slides tube 3 relative to tube 4, to lengthen or shorten the boathook, i.e., by moving the handle end (FIG. 4) further from, or closer to the hook end (FIG. 1). Once moved to a desired length, the user twists tube 1 in the opposite direction relative to tube 2, which serves to move the cam devices 10 and 12 into their engaged positions to secure tube 1 to tube 2 and tube 3 to tube 4 as shown in FIG. 3. This engagement effectively maintains the boathook at the desired length (via mutually engaged tubes 1 and 2), while also permitting mutually engaged tubes 3 and 4 to move axially as a single unit in response to sliding movement of the handle 14 (FIG. 1), to actuate the hook 20 (FIG. 4).

Moreover, a method 110 for fabricating the adjustable length clasping boathook 100 described hereinabove is shown and described with respect to the following Table I.

As shown, at 120, tubes 1 and 2 are telescopingly engaged for slidable movement relative to one another along a common central axis (axial direction), to provide selective adjustability of a length of the boathook. Cam-lock device 10 is disposed between tubes 1 and 2 at 122, so that tube 1 is torsionally movable about the axis relative to tube 2 between tight and loose positions. At 124, tubes 3 and 4 are disposed coaxially with, and internally to, tubes 1 and 2, the third and fourth tubes being telescopingly engaged for slidable movement relative to one another in the axial direction in tandem with said axial movement of said first and second tubes. Cam-lock device 12 is disposed between tubes 3 and 4 at 126, wherein the third tube is torsionally movable about the axis relative to the fourth tube between tight and loose positions so that the second cam-lock device respectively opposes and permits axial movement of said third and fourth tubes relative to one another. At 128, tubes 1 and 3 are configured to be slidable relative to one another in the axial direction, while being fixed to one another in the torsional direction such as by installation 130 of a slidable handle 14 coupled to a proximal end portion of the third tube, wherein the third tube slides axially with the handle relative to tube 1 as shown and described hereinabove. At 132, tubes 2 and 4 are configured to be slidable relative to one another in the axial direction, while being fixed to one another in the torsional direction such as by installation 134 of hook 20 at a distal end portion of tubes 2 and 4, and so that axial movement of tube 4 relative to tube 2 pivots the hook between open and closed positions as shown and described hereinabove.

With this construction, torsional movement of the handle 14 to the loose position (as shown in FIG. 5) enables telescoping movement of tubes 1 and 3 relative to tubes 2 and 4 to vary the length of the boathook 100. Torsional movement of the handle 14 to the tight position (as shown in FIG. 6) engages the cam-lock devices 10 and 12 to substantially lock the boathook 100 at a desired length. Subsequent back and forth axial movement of the handle 14 relative to tube 1 serves to respectively actuate the hook 20 between open and closed positions.

TABLE I

| | |
|---|---|
| 120 | telescopingly engage tubes 1 and 2 |
| 122 | Place cam-lock device 10 between tubes 1 and 2 |
| 124 | Place tubes 3 and 4 coaxially and internally to tubes 1 and 2 |
| 126 | Place cam-lock device 12 between tubes 3 and 4 |
| 128 | Configure tubes 1 and 3 for relative axial motion and fixed torsional motion |
| 130 | Install slidable handle 14 |
| 132 | Configure tubes 2 and 4 for relative axial motion and fixed torsional motion |
| 134 | Install pivotable hook 20 |

The present invention has been described in particular detail with respect to various possible embodiments, and those of skill in the art will appreciate that the invention may be practiced in other embodiments. First, the particular naming of the components, capitalization of terms, the attributes, data structures, or any other programming or structural aspect is not mandatory or significant, and the mechanisms that implement the invention or its features may have different names, formats, or protocols. Also, the particular division of functionality between the various system components described herein is merely exemplary, and not mandatory; functions performed by a single system component may instead be performed by multiple components, and functions performed by multiple components may instead performed by a single component.

Various systems may also be used with programs in accordance with the teachings herein, or it may prove convenient to construct more specialized apparatus to perform the required method steps. The required structure for a variety of these systems will be apparent to those of skill in the art, along with equivalent variations. In addition, the present invention is not described with reference to any particular programming language. It is appreciated that a variety of programming languages may be used to implement the teachings of the present invention as described herein, and any references to specific languages are provided for disclosure of enablement and best mode of the present invention.

Finally, it should be noted that the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention, which is set forth in the following claims. It should be further understood that any of the features described with respect to one of the embodiments described herein may be similarly applied to any of the other embodiments described herein without departing from the scope of the present invention.

Having thus described the invention, what is claimed is:

1. An adjustable length clasping boathook comprising:

first and second tubes telescopingly engaged for slidable movement relative to one another along a common central axis, to selectively adjust a length of the boathook from a proximal end portion of the first tube to a distal end portion of the second tube;

a first cam-lock device disposed between said first and second tubes, wherein the first tube is torsionally movable about the axis relative to the second tube between tight and loose positions so that the first cam-lock device respectively opposes and permits axial movement of said first and second tubes relative to one another;

third and fourth tubes disposed coaxially with, and internally to, the first and second tubes, the third and fourth tubes telescopingly engaged for slidable movement relative to one another in the axial direction in tandem with said axial movement of said first and second tubes;

a second cam-lock device disposed between said third and fourth tubes, wherein the third tube is torsionally movable about the axis relative to the fourth tube between tight and loose positions so that the second cam-lock device respectively opposes and permits axial movement of said third and fourth tubes relative to one another;

the first tube and the third tube being slidable relative to one another in the axial direction, while being fixed to one another in the torsional direction;

the second tube and the fourth tube being slidable relative to one another in the axial direction, while being fixed to one another in the torsional direction;

a handle disposed at the proximal end portion of the first tube, the handle being slidable relative to the first tube in the axial direction, while being fixed relative to the first tube in the torsional direction;

the handle being coupled to a proximal end portion of the third tube, wherein the third tube slides axially with the handle relative to the first tube, and wherein the first and third tubes move in the torsional direction with the handle to simultaneously move the first and second cam-lock devices between said tight and loose positions;

a hook pivotably disposed at a distal end portion of the second tube;

the hook being coupled to a distal end portion of the fourth tube, wherein axial movement of the fourth tube relative to the second tube pivots the hook between open and closed positions;

wherein torsional movement of the handle to the loose position enables telescoping movement of the first and third tubes relative to the second and fourth tubes to vary the length of the boathook, and torsional movement of the handle to the tight position engages the first and second cam-lock devices to substantially lock the boathook at a desired length and subsequent back and forth axial movement of the handle relative to the first tube serves to actuate the hook between open and closed positions, respectively.

2. The boathook of claim 1, further comprising:

the handle being captured within an axially extending slot of the first tube to permit the handle to slide relative to the first tube in the axial direction while limiting movement of the handle relative to the first tube in the torsional direction; and the handle being immovably fastened to the third tube;

wherein the first tube and the third tube are fixed to one another in the torsional direction by the handle.

3. The boathook of claim 2, wherein the handle is immovably fastened to the third tube by a mechanical fastener.

4. The boathook of claim 1, further comprising:

the hook being captured within an axially extending slot of the second tube and pivotably fastened to the second tube to enable the hook to pitch relative to the axial direction while limiting movement of the hook relative to the second tube in the torsional direction; and the hook being pivotably fastened to the fourth tube to enable the hook to pitch relative to the axial direction while limiting movement of the hook relative to the fourth tube in the torsional direction;

wherein the second tube and the fourth tube are fixed to one another in the torsional direction by the hook.

5. The boathook of claim 4, wherein the hook includes a first bight portion on a distal side, and a second bight portion on a proximal side, said first and second bight portions each being sized and shaped to receive a line therein.

6. The boathook of claim 4, wherein the hook is pivotably fastened to a distal end portion of the second tube with a first pivot pin passing through a base portion of the hook.

7. The boathook of claim 6, wherein the hook is pivotably fastened to a distal end portion of the fourth tube with a second pivot pin passing through the base portion of the hook at a position spaced from the first pivot pin.

8. The boathook of claim 1, wherein the tubes are fabricated from a polymeric material.

9. The boathook of claim 1, wherein the tubes are metallic.

10. The boathook of claim 9, wherein the first and second cam lock devices are fabricated from a polymeric material.

11. The boathook of claim 10, wherein the hook is fabricated from a polymeric material.

12. The boathook of claim 1, further comprising a biasing means disposed between the first tube and the third tube, the biasing means configured to bias the handle towards a rest position.

13. The boathook of claim 12, wherein the biasing means is configured to bias the handle towards a rest position at the proximal end of the first tube.

14. A method for fabricating an adjustable length clasping boathook, the method comprising:

telescopingly engaging first and second tubes for slidable movement relative to one another along a common central axis, to provide selective adjustability of a length of the boathook from a proximal end portion of the first tube to a distal end portion of the second tube;

disposing a first cam-lock device between said first and second tubes, wherein the first tube is torsionally movable about the axis relative to the second tube between tight and loose positions so that the first cam-lock device respectively opposes and permits axial movement of said first and second tubes relative to one another;

disposing third and fourth tubes coaxially with, and internally to, the first and second tubes, the third and fourth tubes being telescopingly engaged for slidable movement relative to one another in the axial direction in tandem with said axial movement of said first and second tubes;

disposing a second cam-lock device between said third and fourth tubes, wherein the third tube is torsionally movable about the axis relative to the fourth tube between tight and loose positions so that the second cam-lock device respectively opposes and permits axial movement of said third and fourth tubes relative to one another;

the first tube and the third tube being slidable relative to one another in the axial direction, while being fixed to one another in the torsional direction; the second tube and the fourth tube being slidable relative to one another in the axial direction, while being fixed to one another in the torsional direction;

disposing a handle at the proximal end portion of the first tube, the handle being slidable relative to the first tube in the axial direction, while being fixed relative to the first tube in the torsional direction;

coupling the handle to a proximal end portion of the third tube, wherein the third tube slides axially with the handle relative to the first tube, and wherein the first and third tubes move in the torsional direction with the handle to simultaneously move the first and second cam-lock devices between said tight and loose positions;

pivotably disposing a hook at a distal end portion of the second tube; and coupling the hook to a distal end portion of the fourth tube so that axial movement of the fourth tube relative to the second tube pivots the hook between open and closed positions;

wherein torsional movement of the handle to the loose position enables telescoping movement of the first and third tubes relative to the second and fourth tubes to vary the length of the boathook, and torsional movement of the handle to the tight position engages the first and second cam-lock devices to substantially lock the boathook at a desired length and subsequent back and forth axial movement of the handle relative to the first tube serves to actuate the hook between open and closed positions, respectively.

15. The method of claim 14, further comprising:

capturing the handle within an axially extending slot of the first tube to permit the handle to slide relative to the first tube in the axial direction while limiting movement of the handle relative to the first tube in the torsional direction; and immovably fastening the handle to the third tube;

wherein the first tube and the third tube are fixed to one another in the torsional direction by the handle.

16. The method of claim 15, comprising using a mechanical fastener to immovably fasten the handle to the third tube.

17. The method of claim 14, further comprising:

capturing the hook within an axially extending slot of the second tube and pivotably fastening the hook to the second tube to enable the hook to pitch relative to the axial direction while limiting movement of the hook relative to the second tube in the torsional direction; and pivotably fastening the hook to the fourth tube to enable the hook to pitch relative to the axial direction while limiting movement of the hook relative to the fourth tube in the torsional direction;

wherein the second tube and the fourth tube are fixed to one another in the torsional direction by the hook.

18. The method of claim 17, comprising providing the hook with a first bight portion on a distal side, and a second bight portion on a proximal side, said first and second bight portions each being sized and shaped to receive a line therein.

19. The method of claim 17, comprising pivotably fastening the hook to a distal end portion of the second tube with a first pivot pin passing through a base portion of the hook.

20. The method of claim 19, comprising pivotably fastening the hook to a distal end portion of the fourth tube with a second pivot pin passing through the base portion of the hook at a position spaced from the first pivot pin.

21. The method of claim 14, wherein the tubes are fabricated from a polymeric material.

22. The method of claim 14, wherein the tubes are metallic.

23. The method of claim 22, wherein the first and second cam lock devices are fabricated from a polymeric material.

24. The method of claim 23, wherein the hook is fabricated from a polymeric material.

25. The method of claim 14, further comprising disposing a biasing means between the first tube and the third tube, the biasing means configured to bias the handle towards a rest position.

26. The method of claim 25, wherein the biasing means is configured to bias the handle towards a rest position at the proximal end of the first tube.

* * * * *